US005541393A

United States Patent [19]

Ikezawa et al.

[11] Patent Number: 5,541,393

[45] Date of Patent: Jul. 30, 1996

[54] SHEET COUNTER SYSTEM WITH CONTROLLED BRAKING

[75] Inventors: Masahiro Ikezawa; Masahiko Nishimura; Haruo Nakagawa; Akemi Iwata, all of Himeji, Japan

[73] Assignee: Glory Kogyo Kabushiki Kaisha, Himeji, Japan

[21] Appl. No.: 179,719

[22] Filed: Jan. 11, 1994

[30] Foreign Application Priority Data

Feb. 8, 1993 [JP] Japan ..... 5-020388

[51] Int. Cl.[6] ..... B61L 1/16; B65H 7/02

[52] U.S. Cl. ..... 235/98 R; 235/98 B; 271/258.01

[58] Field of Search ..... 235/98 R, 98 A, 235/98 B, 98 C; 271/258.01, 259

[56] References Cited

U.S. PATENT DOCUMENTS 3,870,868 3/1975 Jones ..... 235/98 R

*Primary Examiner*—Cassandra C. Spyrou

*Attorney, Agent, or Firm*—Wenderoth, Lind & Ponack

[57] ABSTRACT

A sheet counter system includes a feeding section, a carrying section, a counting section, a stacking section and a control section. When the length of a sheet or the like is less than a length reference value, the control section starts braking of the feeding section when the front end of an n-th sheet (n is a predetermined set value) which has been fed out is detected by the counting section. When the length of the sheet is greater than the length reference value, the control section starts braking of the feeding section when a carrying distance after the front end of the n-th sheet which has been fed out is detected by the counting section reaches a predetermined distance to thereby stop feeding by the feeding section when the counted result of the counting section reaches a predetermined number of sheets. Control can be performed by taking feeding speed into consideration.

10 Claims, 16 Drawing Sheets

SHEET COUNTER SYSTEM WITH CONTROLLED BRAKING

BACKGROUND OF THE INVENTION

1. Field of the Invention

This invention relates to a sheet counter system, e.g., a sheet counter or a sheet discriminating counter, etc., i.e., a system for carrying out counting processing of bills, checks or slips, etc.

2. Description of the Prior Art

A conventional sheet counter system generally has a feeding part for feeding out, one by one, sheets or the like stacked within a hopper section; a carrying part for carrying the sheets or the like fed out by the feeding part; a counting part for counting the sheets or the like carried by the carrying part; and a stacking part for stacking the sheets or the like counted by the counting part.

The essential part of one example of such conventional sheet counter system will now be described with reference to FIGS. 15A and 15B.

In these figures, a kicker roller 32, feed rollers 33 (see FIG. 15B) at opposite ends of a rotary shaft 41, and a gate roller 34 constitute feeding (drawing) means for feeding out sheets or the like stacked or accumulated within a hopper section 31. Practically, two kicker rollers 32 are provided along their common axis, however, the explanation will be made with reference to only one kicker roller. Respective components of this feeding means are driven by a drive motor (not shown).

Furthermore, a feed roller 33' at a central position between rollers 33, a roller 35 opposite to the feed roller 33' and acceleration rollers 36, 37 constitute carrying (transfer) means for carrying (transferring) sheets or the like fed out by the feeding means. Such acceleration rollers 36, 37 are also driven by the above-described drive motor. The sheets or the like which have been fed out by the above-described feeding means are carried (transferred) along a carrier (transferring) path formed by guide plates 39*a*, 39*b*. In this example, the acceleration roller 36 is caused to have large inertia. Thus, acceleration rollers 36, 37 are driven by inertia even after the drive motor is stopped so that they carry or transfer sheets or the like.

A stacker 40 and a stacker fan 38, practically two coaxial stacker fans, constitute stacking means. Stacker fan 38 stacks sheets or the like carried by the carrying means into stacker 40. Stacker fan 38 is driven by an independent motor.

A light emitting element S and a light receiving element S' detect sheets or the like and constitute counting means for counting the number of sheets or the like carried by the above-described carrying means.

One processing mode known to be carried out by sheet counter systems of this kind is counting batch processing. This counting batch processing is a mode adapted so that when a predetermined number (hereinafter referred to as "a batch number") of sheets or the like are stacked within the stacker 40, the feeding means and/or the carrying means are once stopped. In accordance with this processing mode, sheets or the like within the stacker 40 are taken out every time the feeding means or the carrying means is stopped. Thereafter, such means is restarted, thereby making it possible to sort a batch number for a second time sheets or the like which have been subjected to counting processing.

For example, when it is assumed that the batch number is "100", the feeding means is stopped at the point in time when the hundredth sheet or the like is fed out from the hopper section 31, so the one hundred first sheet and sheets succeeding thereto are not fed out from the hopper section 31. When the hundredth sheet or the like is carried or transferred up to the stacker fan 38, the carrying means is stopped.

A deceleration (braking) method when the feeding means is caused to be stopped is shown in FIG. 16. In this figure, the ordinate is a feeding speed (number of sheets/minute) and the abscissa is an elapsed time t. As stated above, in the conventional sheet counter system, when the final sheet (the hundredth sheet in this example) or the like before stopping is detected by the light receiving element S' of the counting means, the drive motor of the feeding means is braked. Thereafter, the feeding speed gradually lowers and becomes equal to zero after completion of the feeding operation.

In such conventional sheet counter system, it is required that the counter system be compact.

However, in the case where such a system is made compact, the spacings between respective rollers 32–37 are shortened. Accordingly, in the case where the drive motor is braked at a timing as shown in FIG. 16, there is the possibility that when the length in a carrying direction of the sheet or the like is long, the drive motor may be stopped with the trailing end of the sheet or the like being between roller pair 33, 34 (see FIGS. 15A and 15B), or remaining within the hopper section 31, so that such sheet or the like fails to be stacked within the stacker 40.

On the contrary, there is employed a method as shown in FIG. 17 to conduct carrying (transfer) for a predetermined distance (40 mm in this example) after the front end of the sheet or the like is detected by the counting means S, S' and thereafter to brake the drive motor, thereby making it possible to eliminate the above-mentioned drawback. Namely, in accordance with this method, even in the case where sheets or the like are long, they can be securely stacked within the stacker 40.

However, when control of the brake of the drive motor is carried out by such timing to retard or delay the timing at which the drive motor is stopped, in the case where sheets or the like are short, opposite to the above, there occurs a new drawback such that when the final (hundredth) sheet or the like before stopping reaches the stacker fan 38, the next (one hundred first) sheet or the like may be fed out from the rollers 33, 34.

Namely, the time period from the time when the one hundredth sheet or the like is carried or transferred from the hopper section 31 and the one hundred first sheet or the like comes into contact with the kicker roller 32, the feed rollers 33 and the gate roller 34 until these rollers are stopped becomes longer as the length of the sheet or the like becomes shorter. Such condition in which a part of the one hundred first sheet protrudes into the transferring path from the feed roller 33 and the gate roller 34 when the hundredth sheet is transferred and the feeding of next sheet is stopped is defined as "excessive feeding".

Since such excessive feeding of the sheet or the like takes place in response to a contact as described above, as the length of the sheet or the like becomes shorter (i.e., the contact time becomes longer), the extend of excessive feeding becomes greater.

Accordingly, when the extend of excessive feeding of the one hundred first sheet or the like becomes greater as described above, the possibility that such sheet or the like may be damaged in taking out the sheet or the like from between rollers 33 and 34 by a user or an operator becomes higher. Even if such sheet or the like can be taken out in such a manner that it is not damaged, there results increased labor for a user. For example, when the number of sheets or the like stacked in advance within the hopper section 31 is one hundred ten (110), and one hundred (100) sheets or the like are stacked within the stacker 40 and the remaining ten (10) sheets or the like are taken out from the hopper section, such problem would occur.

Furthermore, in such a case that a sheet detection sensor is provided in proximity of the kicker roller 32 at the hopper section 31 to detect whether or not there are remaining sheets or the like, inconveniences as described below also take place.

(1) There are instances where, when one hundred and one sheets or the like are stacked in the hopper 31 and the one hundred first sheet is excessively fed out, if the extent of excessive feeding is large, then the trailing end of that sheet or the like is passed through the sheet detection sensor position, so it will be judged that there is no sheet or the like within the hopper section 31, even though the one hundred and first sheet or the like is left therein.

(2) Even in the case where, when the number of sheets or the like stacked in advance within the hopper section 31 is one hundred ten (110), and one hundred (100) sheets or the like are fed and stacked in the stacker 40 and the remaining ten (10) sheets or the like are taken out from the hopper section, an operator may forget to remove the one hundred first sheet or the like which has been excessively fed out. Thus, it may be judged that no sheet or the like is left within the hopper section 31 in spite of the one hundred and first sheet or the like being left within the hopper section 31.

(3) In the case where there remains one sheet or the like which has been excessively fed out in this way and counting processing is performed, remaining sheets and the like are also counting processed. As a result, the counted number of sheets or the like and the counted number of sheets or the like stacked within the hopper section 31 are not in correspondence with each other, thus constituting an error in the overall operation.

On the other hand, in a conventional sheet counter system as described above, it is also required to improve the processing speed.

When it is now assumed that the carrying speed of the sheet or the like is caused to be high in order to improve the processing speed, in the case where the drive motor is braked after the final sheet or the like before stopping is detected by the light receiving element S' as shown in FIG. 16, the stop timing of the drive motor is delayed, so the next sheet or the like would be fed out. Accordingly, also in this case, drawbacks as in the above-mentioned items (1)–(3) take place.

On the contrary, in order to eliminate such drawback, the present inventors tried a method in which when a sheet (the ninety sixth sheet in this example) or the like preceding by a fixed number of sheets relative to the final sheet before stopping is detected by the light receiving element S', the feeding speed is caused to be reduced, and the drive motor is braked after the final (hundredth) sheet or the like is detected by the light receiving element S'.

With such method, however, feeding speeds at the point in time when the hundredth sheet or the like is detected by the light receiving element S' would become diverse, thus failing to precisely control the stop timing. For example, when the stop timing is caused to be earlier than a set value, the carrying means is stopped before the hundredth sheet or the like reaches the stacker fan 38, and such sheet will be left within the carrying path.

For this reason, the present inventors tried a method in-which a feeding speed at the point in time when the hundredth sheet or the like is detected by the light receiving element S' is measured, whereby when the measured speed is less than a reference speed, the sheet or the like is further carried or transferred by a predetermined distance thereafter to brake the drive motor.

With such method, in the case where the length of the sheet or the like is long, a satisfactory result was provided. In contrast, in the case where the length of the sheet is short, the one hundred first sheet or the like was fed out. Accordingly, also in this case, drawbacks as in the above-described items (1)–(3) may take place.

SUMMARY OF THE INVENTION

Accordingly, an object of this invention is to provide a sheet counter system in which, even when counting processing of sheets or the like having a long length in a carrying direction is carried out, the counter system is capable of securely stacking processed sheets or the like, and even when counting processing of sheets or the like having a short length in the carrying direction is carried out, there is no possibility that a sheet or the like subsequent to a sheet of a batch number may be fed out.

According to one aspect of the present invention, there is provided a sheet counter system comprising:

feeding means for feeding out, one by one, sheets or the like stacked within a hopper section;

carrying means for carrying the sheets or the like fed out by the feeding means;

counting means for counting said sheets or the like carried by the carrying means;

stacking means for stacking the sheets or the like counted by the counting means; and control means operable such that, when a length of a control means such that in the case where the length of said sheet or the like is less than a length reference value, the control means starts braking of the feeding means when the front end of an n-th sheet (n is a predetermined set value) or the like which has been fed out is detected by the counting means, while when the length of the sheet or the like is greater than the length reference value, the control means starts braking of the feeding means when a carrying distance after the front end of the n-th sheet or the like which has been fed out is detected by the counting means reaches a predetermined distance to thereby stop feeding by the feeding means when the counted result of the counting means reaches a predetermined number of sheets.

In the first invention, when the length of the sheet or the like is less than the length reference value, when the front end of an n-th sheet (n is a predetermined set value) or the like is detected by the counting means, braking of the feeding means is started, while when the length of the sheet or the like is greater than the length reference value, when a carrying distance after the front end of the final sheet or the like before stopping is detected by the counting means reaches a predetermined distance, braking of the feeding means is started.

According to another aspect of the present invention, there is provided a sheet counter comprising:

feeding means for feeding out, one by one, sheets or the like stacked within a hopper section;

carrying means for carrying the sheets or the like fed out by said feeding means;

counting means for counting the sheets or the like carried by the carrying means;

stacking means for stacking the sheets or the like counted by the counting means; and control means operable such that, when a sheet or the like preceding by a fixed number of sheets relative to an n-th sheet (n is a predetermined set value) or the like is detected by the counting means, the control means starts braking of the feeding means, When the length of sheet or the like is less than a length reference value and in the case where the length of the sheet or the like is greater than the length reference value and a feeding speed when the front end of the n-th sheet or the like which has been fed out is detected by the counting means is above a speed reference value, the control means starts braking of the feeding means when the front end of the n-th sheet or the like is detected, and when the length of the sheet or the like is greater than the length reference value and a feeding speed when the front end of the n-th sheet or the like which has been fed out is detected by the counting means is smaller than the speed reference value, the control means starts braking of the feeding means when a carrying distance from the time of detection of the front end of the n-th sheet or the like reaches a predetermined distance to thereby stop feeding by the feeding means when the counted result of the counting means reaches a predetermined number of sheets.

In this aspect of the invention, when the length of the sheet or the like is less than a length reference value and when the length of the sheet or the like is greater than the length reference value and a feeding speed when the front end of an n-th sheet (n is a predetermined set value) or the like which has been fed out is detected by the counting means is above a speed reference value, when the front end of the n-th sheet or the like which has been fed out reaches the counting means, braking of the feeding means is started. On the other hand, when the length of the sheet or the like is greater than the length reference value and a feeding speed when the front end of the n-th sheet or the like which has been fed out is smaller than the speed reference value, when a carrying distance after the front end of the n-th sheet or the like which has been fed out reaches the counting means reaches a predetermined distance, braking of the feeding means is started.

Accordingly, it is possible to provide a sheet counter system in which even in the case where counting processing of sheets or the like having a long length in a carrying direction is carried out, processed sheets or the like can be securely stacked and even in the case where counting processing of sheets or the like having a short length in the carrying direction is carried out, there is no possibility that a sheet succeeding to a sheet of the batch number may be fed out.

DESCRIPTION OF THE PREFERRED EMBODIMENT

A preferred embodiment of a sheet counter system according to this invention will now be described with reference to an example of a bill counter system capable of carrying out counting processing of a bill having a length of 50–100 mm along a carrying (transfer) direction.

Figure 1:
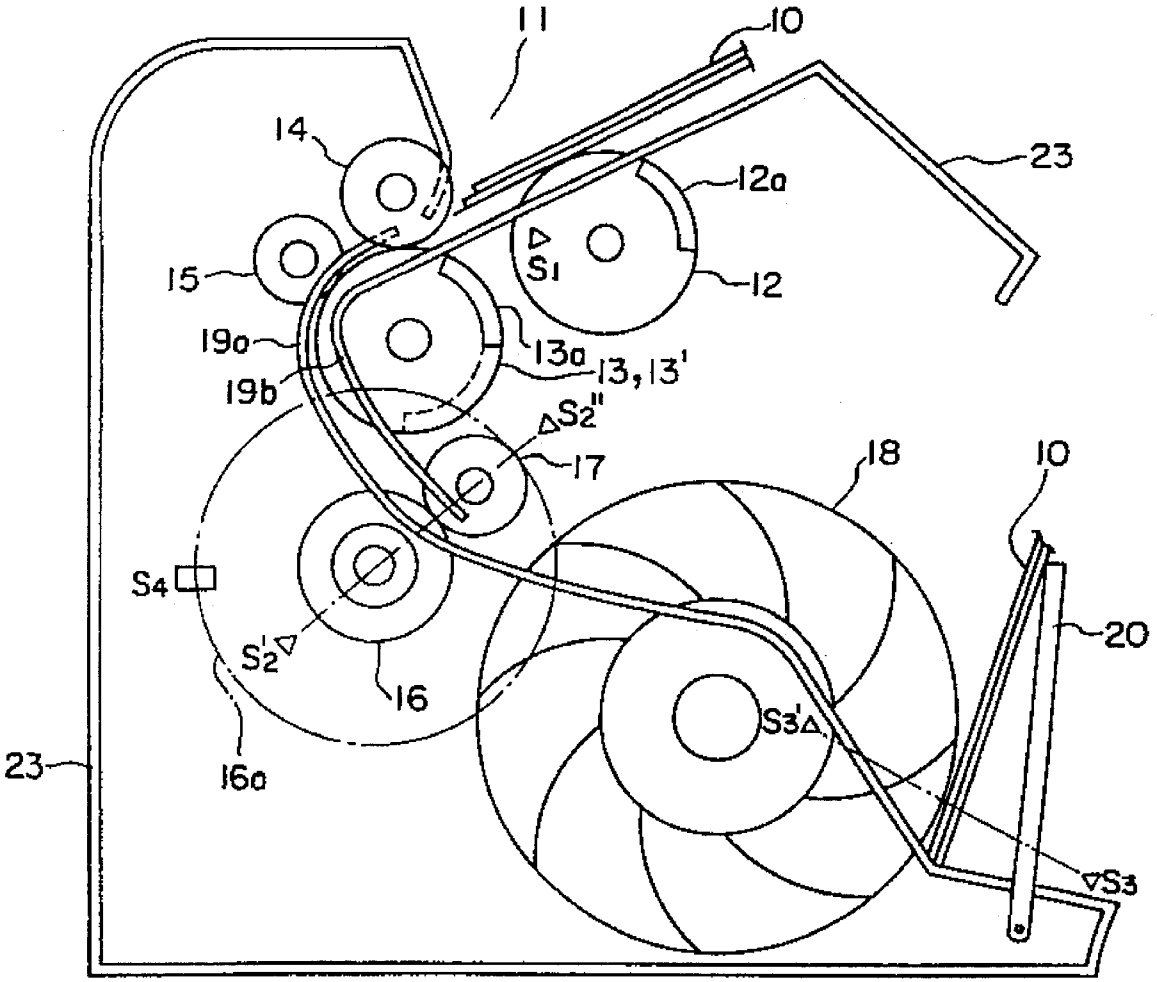
FIG. 1 is a cross sectional view showing a structural assembly of a sheet counter system according to an embodiment of this invention.
Figure 2:
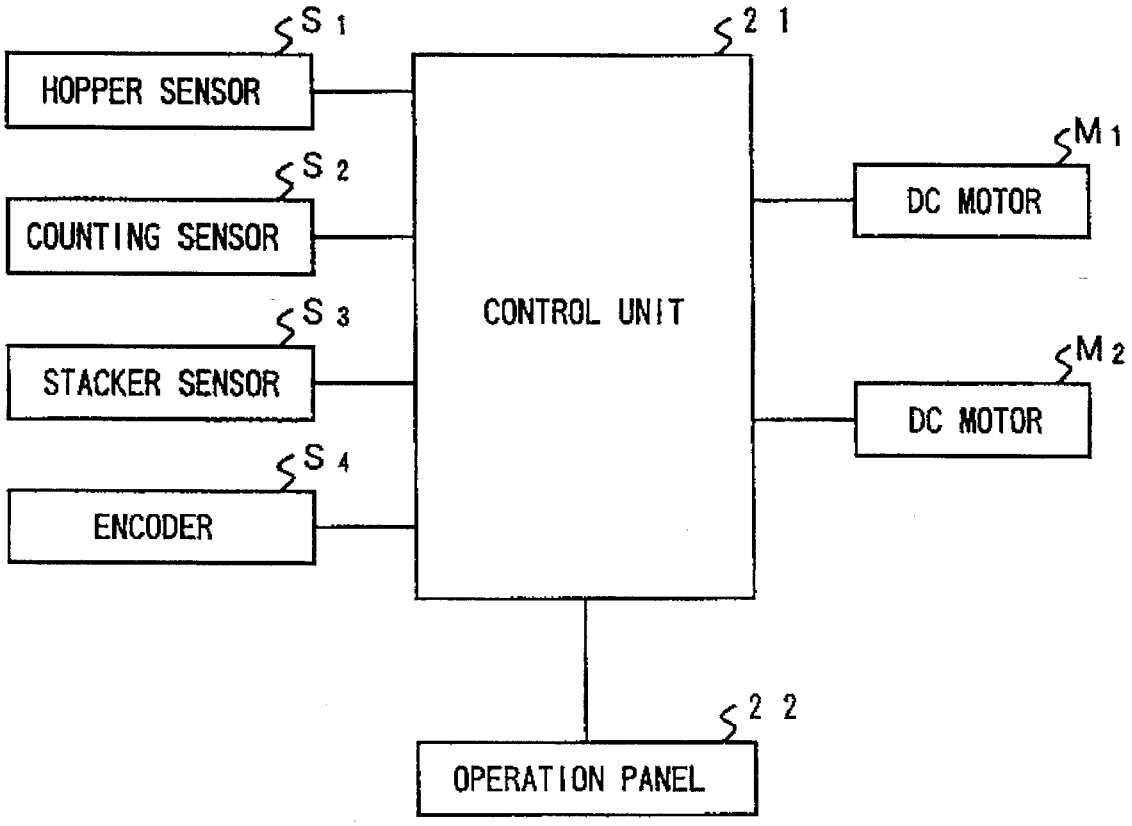
FIG. 2 is a block diagram showing a control circuit of the sheet counter system shown in FIG. 1.

The structural assembly of the bill counter system according to this embodiment is shown in FIG. 1. Furthermore, a control circuit of this bill counter system is shown in a block diagram in FIG. 2.

Figure 15A:
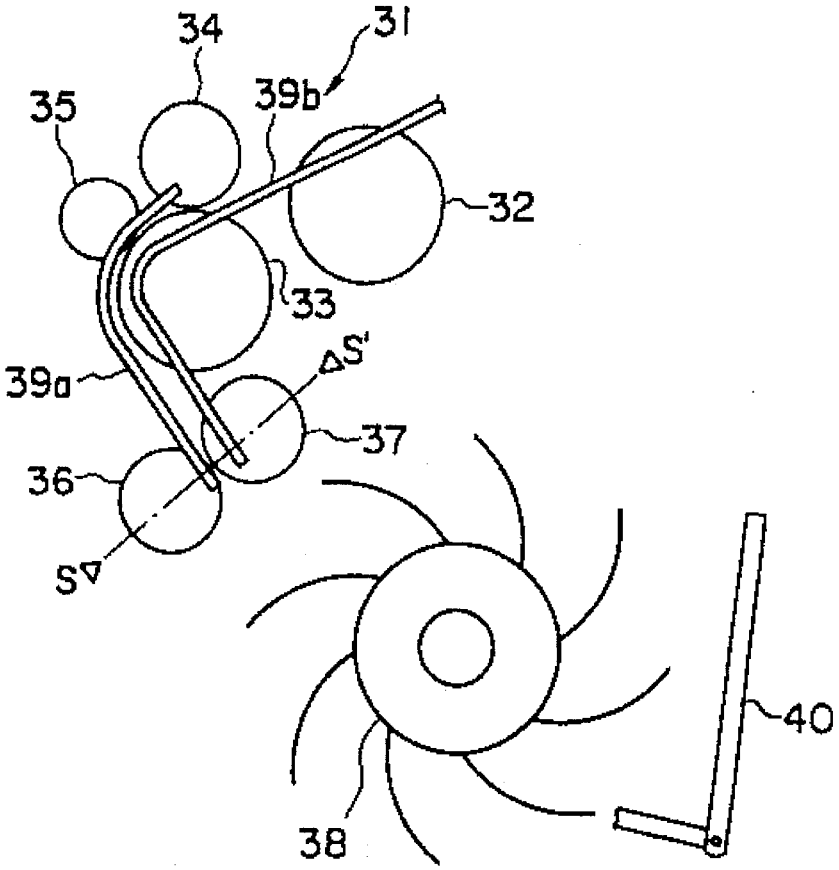
FIG. 15A PRIOR ART
FIG. 15A is a cross sectional view showing an example of a structural assembly of a conventional sheet counter system.
Figure 15B:
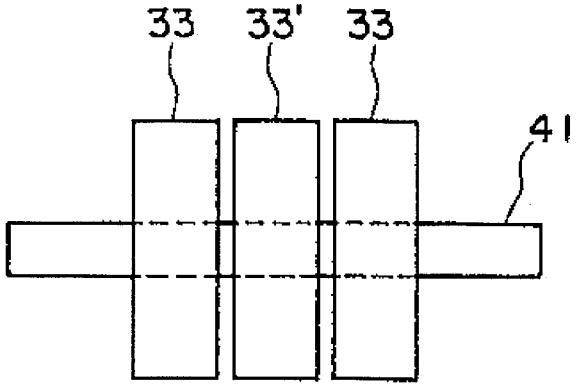
FIG. 15B PRIOR ART
FIG. 15B is a cross sectional view showing an example of the structural assembly of the conventional sheet counter system.
Figure 16:
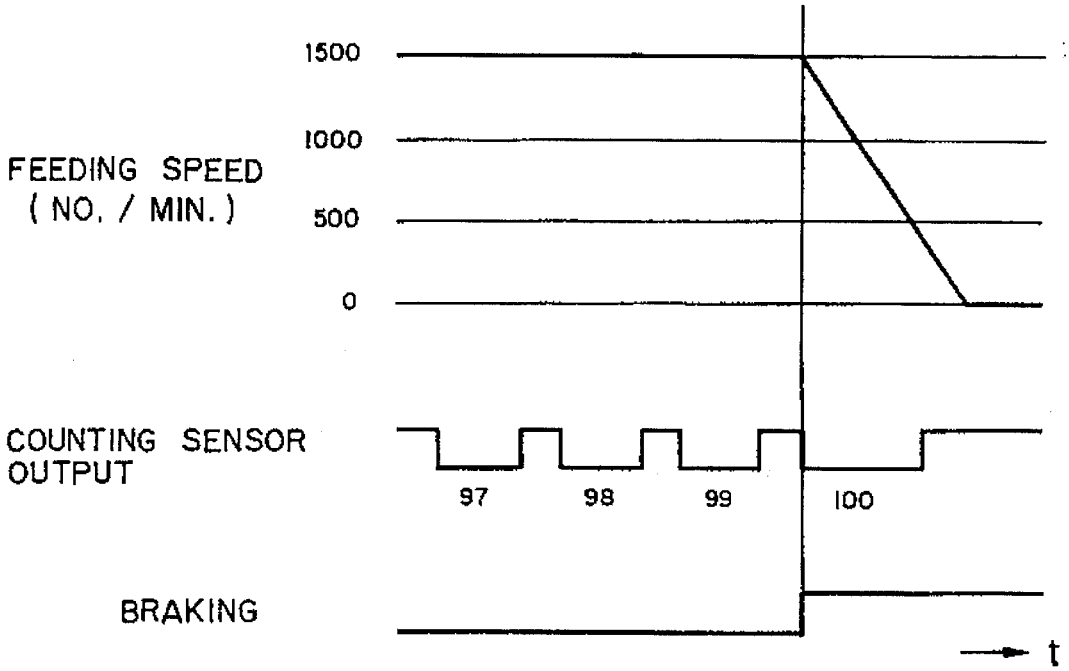
FIG. 16 PRIOR ART
FIG. 16 is a timing chart showing an example of the operation of the sheet counter system shown in FIGS. 15A and 15B.
Figure 17:
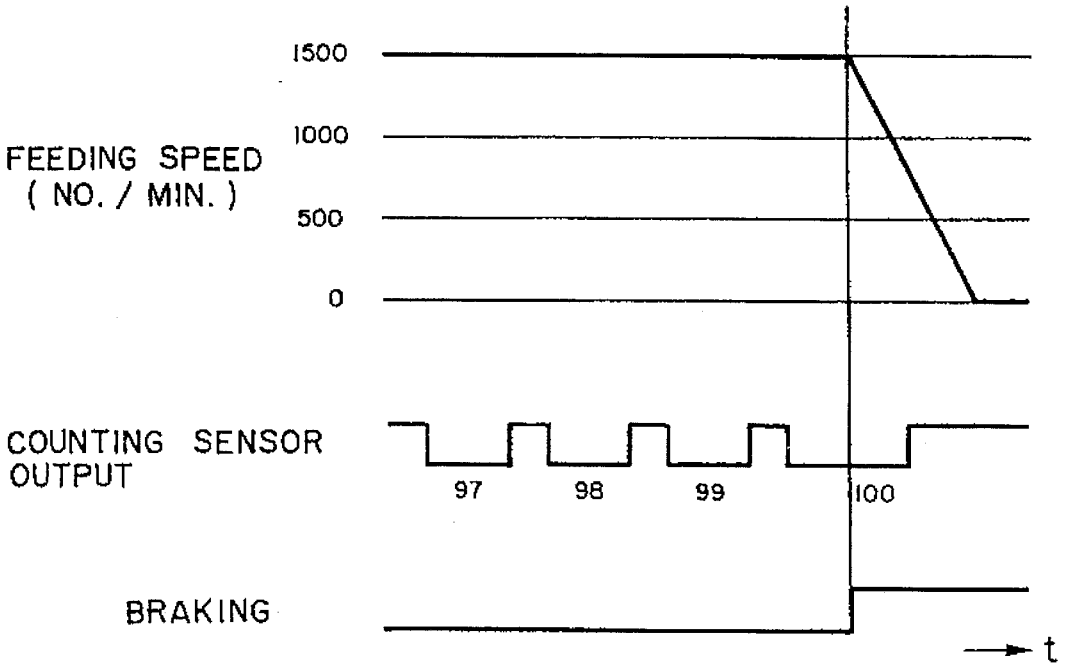
FIG. 17 PRIOR ART
FIG. 17 is a timing chart showing another example of the operation of the sheet counter system shown in FIG. 15A and 15B.

In FIG. 1, a kicker roller 12, feed rollers 13, and a gate roller 14 within a casing 23 constitute feeding means for feeding out bills 10 stacked within a hopper section 11. Respective components of the feeding means are driven by a DC motor $M_1$ (see FIG. 2). In this embodiment, feed rollers 13 are fixed on a feed roller shaft at positions on opposite sides of a feed roller 13' (which will be described later) constituting part of the carrying means, in the same manner as in FIG. 15B.

In this embodiment, a roller having a diameter of 40 mm (outer circumference is about 125 mm) and provided with a friction portion 12a having an angle of about 60 degrees is used as the kicker roller 12. Furthermore, a roller having a diameter of 40 mm (outer circumference is about 125 mm) and provided with a friction portion 13a having an angle of about 75 degrees is used as the feed roller 13. This friction portion **13*a* is caused to be of a structure such that it rotates in a manner delayed by four degrees relative to the friction portion 12***a* of the kicker roller 12.

The feed roller 13' at the central portion fixed on the feed roller shaft, a roller 15 opposite to the feed roller 13', and acceleration rollers 16, 17 constitute carrying means for carrying (transferring) bills 10 fed out by the feeding means. As the feed roller 13', a roller having a diameter of 40 mm (outer circumference is about 125 mm) and provided with a friction portion 13*a'* having an angle of about 155 degrees is used similarly to the above-described feed roller 13. The feed roller 13' is caused to be of a structure such that it rotates in a manner delayed by four degrees relative to the friction portion 12*a* of the kicker roller 12. Therefore, the initial end of the friction portion 13*a* and the initial end of the friction portion 13*a'* have the same angular position. The acceleration rollers 16, 17 are connected to the above-described DC motor $M_1$ by means of a one-way clutch. In addition, a fly-wheel 16*a* doubling as a slit circular plate is attached on the acceleration roller 16 so that inertia is caused to be large. Thus, the acceleration rollers 16, 17 are driven by inertia even after the DC motor $M_1$ is stopped, thus making it possible to carry bills 10.

Guide plates 19*a*, 19*b* form a carrying path for guiding bills 10 Carried or transferred to a stacker fan 18 which will be described later.

The stacker fan 18 serves to take, one by one, bills 10 carried by the carrying means into the fans, thus to stack them within a stacker 20. This stacker fan 18 is driven by an independent motor $M_2$ (see FIG. 2).

Assuming now that the circumferential speed of the kicker roller 12 is $V_1$, respective components are rotationally driven so that the circumferential speed of the feed roller 13 is $V_1$, the circumferential speeds of the acceleration rollers 16, 17 are 1.2 $V_1$, and the circumferential speed of the stacker fan 18 is $V_1/3$.

A hopper sensor $S_1$ detects whether or not there is any bill 10 within the hopper section 11. In this embodiment, the distance between the hopper sensor $S_1$ and the gate roller 14 is set to 30 mm.

A light receiving element $S_2'$ and a light emitting element $S_2''$ constitute a counting sensor $S_2$ for counting the number of bills 10 carried by the above-described carrying means. In this embodiment, the carrying distance between the counting sensor $S_2$ and the above-described gate roller 14 is set to 70 mm, and the carrying distance between the hopper sensor $S_1$ and the counting sensor $S_2$ is set to 100 mm.

A stacker sensor $S_3$ detects whether or not there is any bill 10 within the stacker 20.

An encoder $S_4$ detects slits formed at fixed intervals at the peripheral portion of the fly-wheel 16*a* doubling as a slit circular plate to thereby measure the circumferential speed thereof. Thus, the feeding speed and the carrying speed of bills 10 are calculated.

A control unit 21 controls DC motors $M_1$, $M_2$ on the basis of signals input from an operation panel 22 and respective sensors $S_1$, $S_2$, $S_3$ and $S_4$.

It is to be noted that while a DC motor is used as each drive motor as described above in this embodiment, an AC motor, etc. may be used as a matter of course. In addition, a short brake is employed for braking of the DC motors $M_1$, $M_2$.

The operation of the bill counter system according to this embodiment will now be described with reference to the flowcharts of FIGS. 3–7 and the timing charts of FIGS. 8–14.

Figure 3:
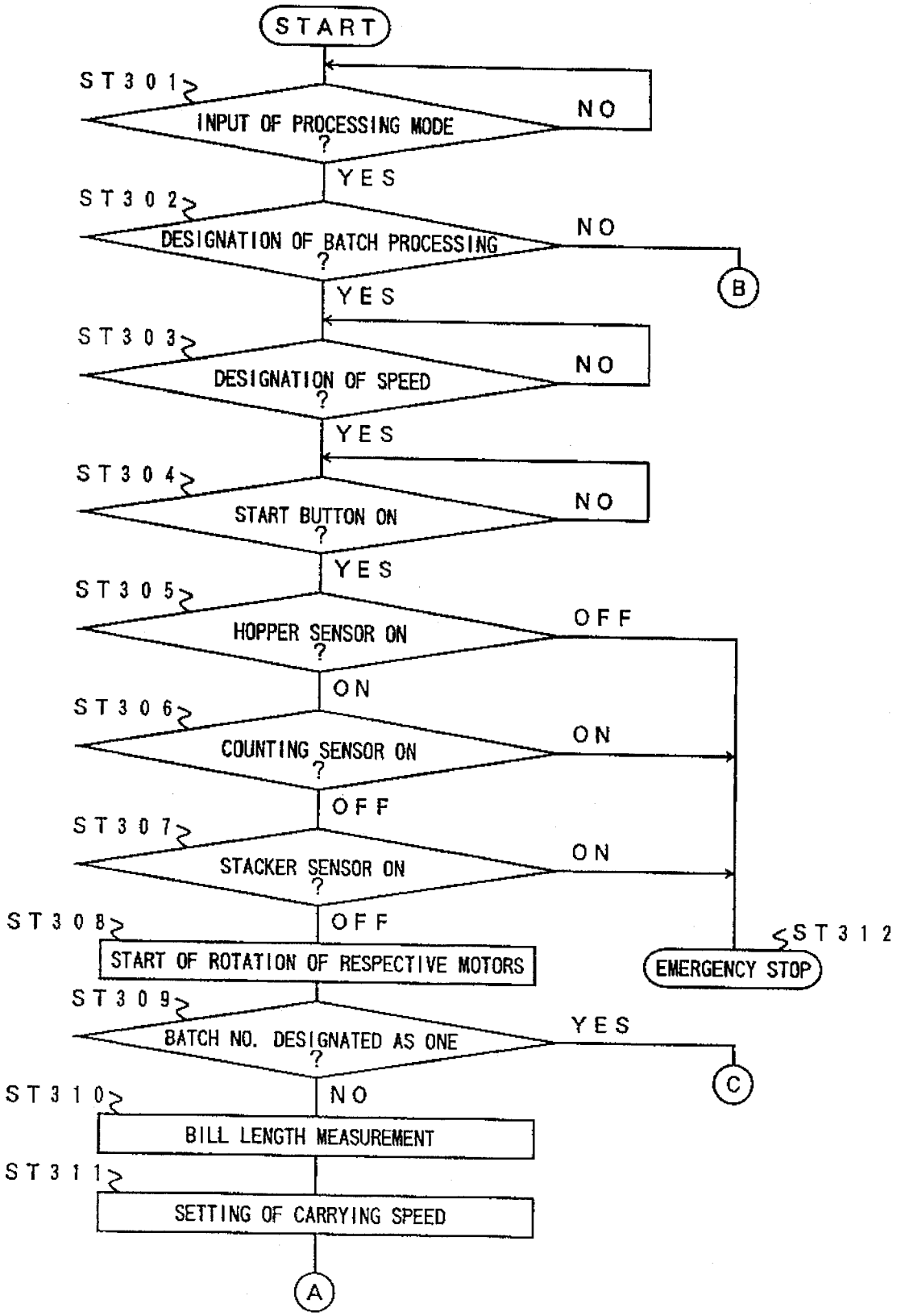
FIG. 3 is a flowchart showing the operations of the sheet counter system shown in FIG. 1.

When a main power supply of the bill counter system is turned ON, the control unit 21 repeats checking as to whether or not designation of the processing mode by the operation panel 22 is carried out (FIG. 3; ST 301). When an operator designates a processing mode, the control unit 21 then judges the kind of the designated processing mode (ST 302). As a result, when it is judged that batch processing is designated, the control unit 21 executes the processing at step ST 303 and steps subsequent thereto. On the other hand, when it is judged that an ordinary counting processing mode (mode for simply counting the total number of bills 10) is designated, the control unit 21 executes the processing at step ST 601 (described later) and steps subsequent thereto (see FIG. 6).

In batch processing, checking as to whether or not designation of a speed by the operation panel 22 is carried out is first repeated (ST 303). When that speed is designated, checking as to whether the start button is turned ON is then repeated (ST 304).

When the start button is turned ON, whether or not bills 10 are stacked within the hopper section 11 is first checked by the hopper sensor (ST 305). As a result, if the hopper sensor $S_1$ is in an OFF state, it is judged that there is no bill 10 in the hopper 11 to stop the bill counter system to inform an operator of it by an alarm, etc. (ST 312).

On the other hand, in the case where the hopper sensor $S_1$ is in an ON state, whether or not bills are clogged within the counter system is then checked by using the counting sensor $S_2$ (ST 306). As a result, if the counting sensor $S_2$ is in an ON state, it is judged that there exists a bill 10, thus stopping the counter system (ST 312). In contrast, if the counting sensor $S_2$ is in an OFF state, whether or not any bill 10 remains within the stacker 20 is then checked by the stacker sensor $S_3$ (ST 307). As a result, if the stacker sensor $S_3$ is in an ON state, it is judged that there exists a bill 10, thus stopping the counter system (ST 312). On the other hand, if the stacker sensor $S_3$ is in an OFF state, it is judged that there is no extraordinary state, thus starting rotation of the DC motors $M_1$, $M_2$ (ST 308).

Subsequently, whether the batch number input by the operation panel 22 is 1 or a value more than 1, i.e., 2 or more is checked (ST 309). As a result, if the batch number is 1, the control unit 21 executes processing at step ST 701 and steps subsequent thereto which will be described later (see FIG. 7).

On the other hand, in the case where the batch number is a value more than 1, i.e. 2 or more, the length in a carrying direction of a bill to be subjected to counting processing is measured by the bill 10 first carried (ST 310). This measurement can be carried out by a time period during which the counting sensor $S_2$ is turned ON and detection of the number of slits of the fly-wheel 16*a* by the encoder $S_4$ within that time period, i.e., count value of the number of pulses.

According to the measured result of the bill length and the speed mode (i.e., circumferential speed of the DC motor $M_1$), the rotational number of the DC motor $M_2$ (i.e., the rotational number of the stacker fan 18) is re-set to values shown in Table 1 (ST 311).

TABLE 1

| | | ROTATION NO. OF $M_2$ | | |
|---|---|---|---|---|
| | | SPEED MODE | | |
| | | 500/MIN. | 1000/MIN. | 1500/MIN. |
| BILL LENGTH | 91 mm or more | 130 rpm | 240 rpm | 240 rpm |
| | Less than 91 mm | 80 rpm | 130 rpm | 130 rpm |

Figure 4:
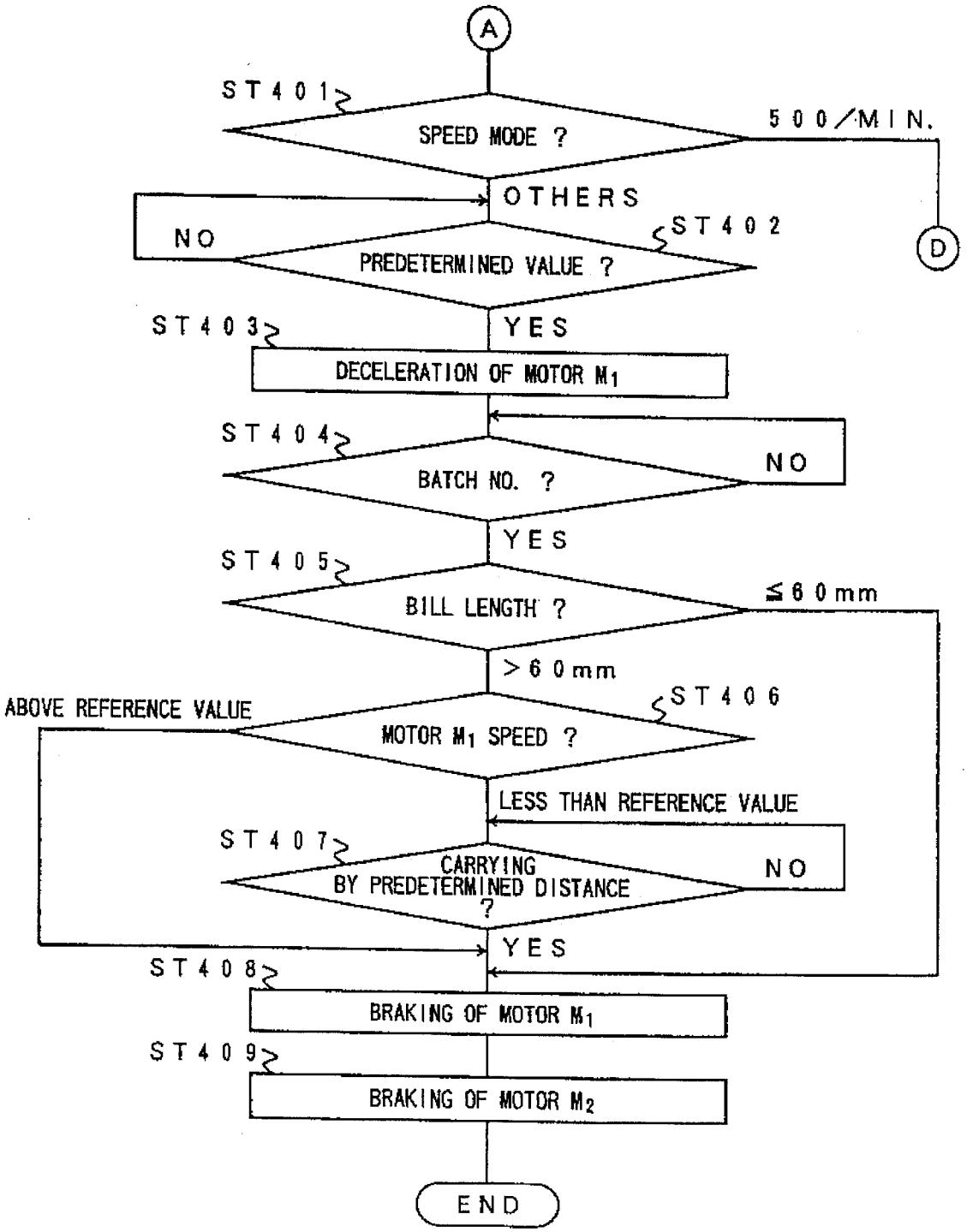
FIG. 4 is a flowchart showing the operations of the sheet counter system shown in FIG. 1.

Subsequently, the control unit 21 judges as to whether the speed mode is 500/minute, 1000/minute or 1500/minute (FIG. 4: ST 401). As a result, In the case where the speed mode is judged to be 500/minute, the control unit 21 executes processing at step ST 501 and steps subsequent thereto which will be described later (see FIG. 5).

On the other hand, in the case where the speed mode is 1000/minute or 1500/minute, checking as to whether or not a count value by the counting sensor $S_2$ reaches a predetermined value, i.e., a predetermined number of bills ("a bill preceding by a fixed number of bills, relative to an n-th bill (n is a predetermined set value" in this invention is detected) is repeated (ST402).

Figure 8:
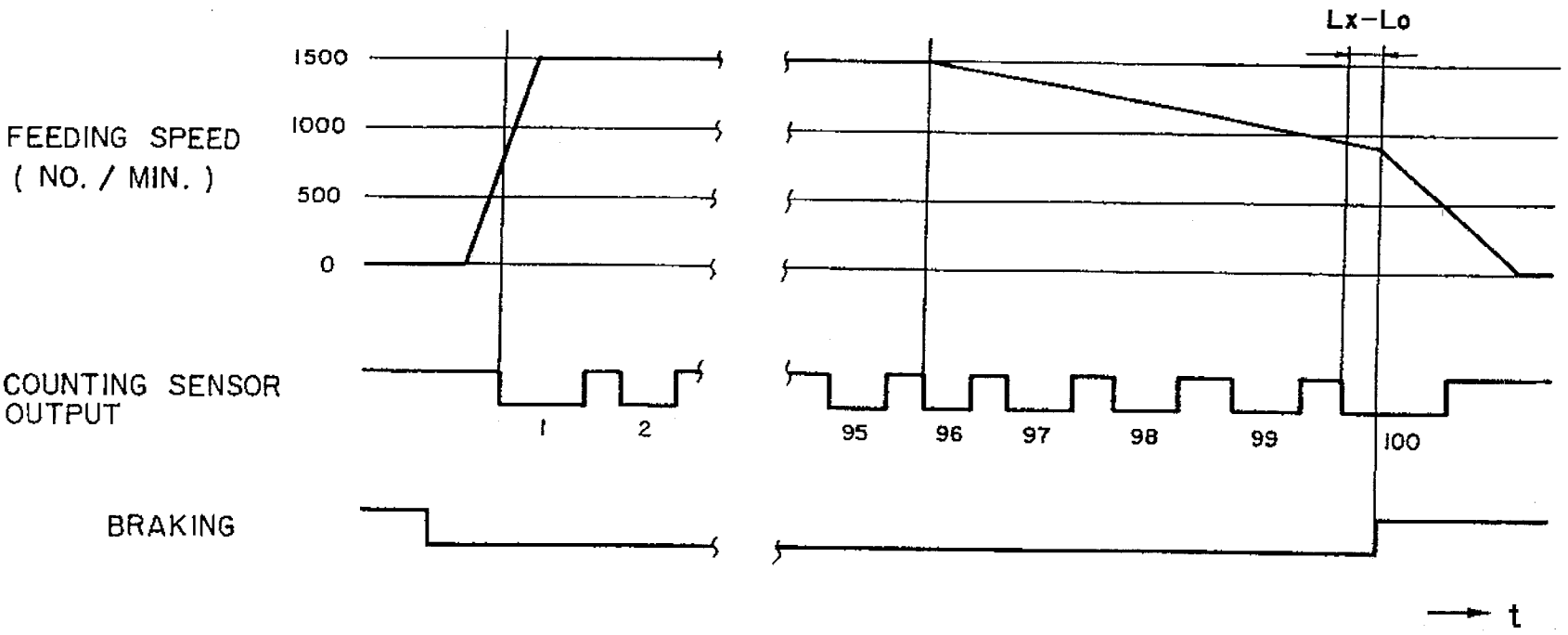
FIG. 8 is a timing chart showing the operation of the sheet counter system shown in FIG. 1.
Figure 9:
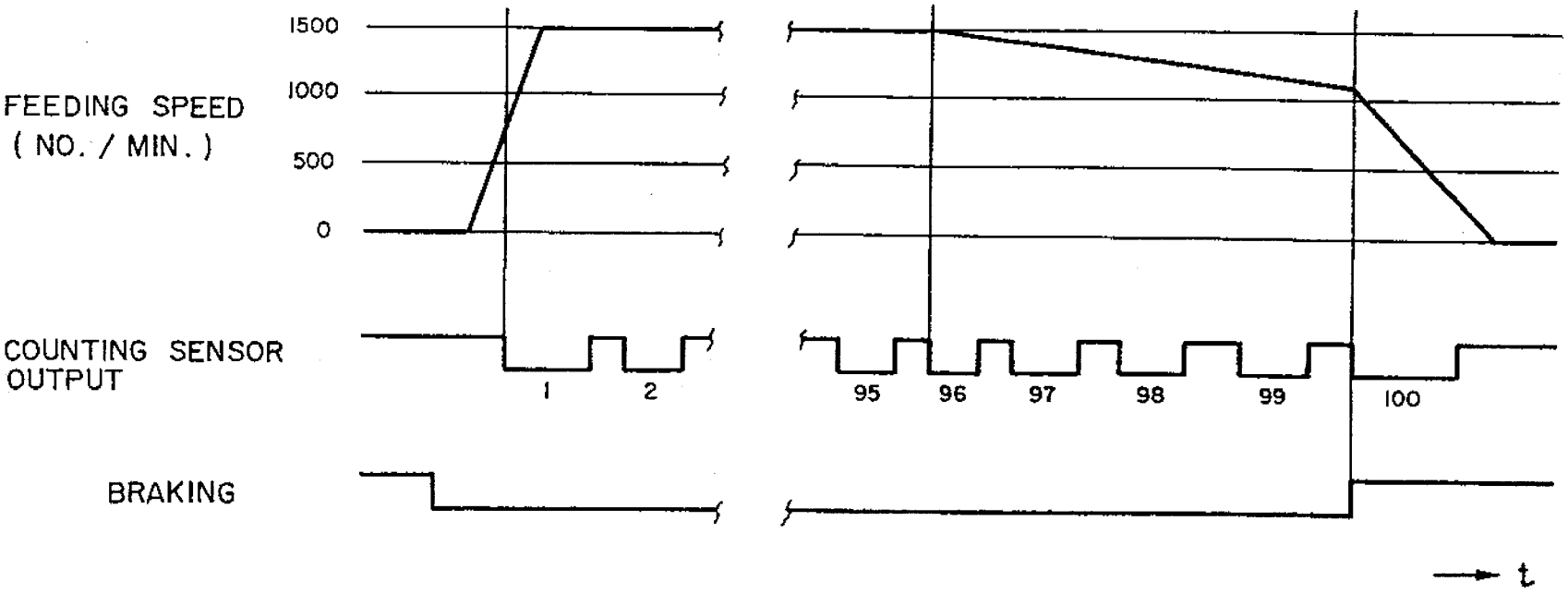
FIG. 9 is a timing chart showing the operation of the sheet counter system shown in FIG. 1.

Assuming now that the batch number is 100, in the case where the speed mode is 1500/minute, when the front end of the ninety sixth bill 10 reaches the position of the counting sensor $S_2$, it is judged that the count value reaches the corresponding number, thus decelerating or braking the DC motor $M_1$ so that the speed of 500/minute is provided (ST 403, see FIGS. 8 and 9). Then, judgment as to whether or not the count value of the counting sensor $S_2$ reaches the batch number (100 in this embodiment) is repeated (ST 404).

When the front end of the bill 10 of the batch number reaches the position on the counting sensor $S_2$, if a measured value $L_x$ of the bill length is greater than a length reference value $L_0$ (which is assumed to be "60 mm" in this case) and the speed of the DC motor $M_1$ (measured value by the encoder $S_4$) is smaller than a speed reference value (which is assumed to be "1000/minute" in this case), the control unit 21 carries the bill 10 by a predetermined distance thereafter to sequentially carry out braking of the DC motors $M_1$, $M_2$ (ST405–ST409) to stop these motors (see FIG. 8). In this embodiment, "a predetermined distance" at this time, i.e., a carrying quantity of the bill 10 is given by $L_x$-$L_0$. In addition, the timing of braking of the DC motor $M_2$ is caused to be in correspondence with a later time point between the time point when a predetermined time (e.g., 500 m sec) elapses after braking of the DC motor $M_1$ is carried out and the time point when no pulse is output from the encoder $S_4$.

When the bill length $L_x$ is greater than the length reference value $L_0$ and the speed of the DC motor $M_1$ is smaller than the speed reference value, this bill 10 is carried by a predetermined distance thereafter to carry out braking of the DC motor $M_1$, thereby preventing the DC motor $M_1$ from being stopped before the final bill 10 is taken into the stacker fan 18.

On the other hand, when the bill length $L_x$ is greater than the length reference value $L_0$ ("60 mm") and the speed of the DC motor $M_1$ (measured value by the encoder $S_4$) is more than 1000/minute, and when the bill length $L_x$ is less than 60 mm (ST 405, 406), the control unit 21 immediately carries out braking of the DC motor $M_1$ (ST 408), thus to stop the DC motor $M_1$ (see FIG. 9). In accordance with the same procedure as in the above-described case, braking of the DC motor $M_2$ is carried out (ST 409).

As stated above, when the bill length $L_x$ is greater than the length reference value $L_0$ and the speed of the DC motor $M_1$ is above the speed reference value, or when the bill length $L_x$ is equal to or smaller than the length reference value $L_0$ braking of the DC motor $M_1$ is immediately carried out, thereby making it possible to prevent the next (one hundred first) sheet or the like from being fed out from the rollers 13, 14.

Figure 10:
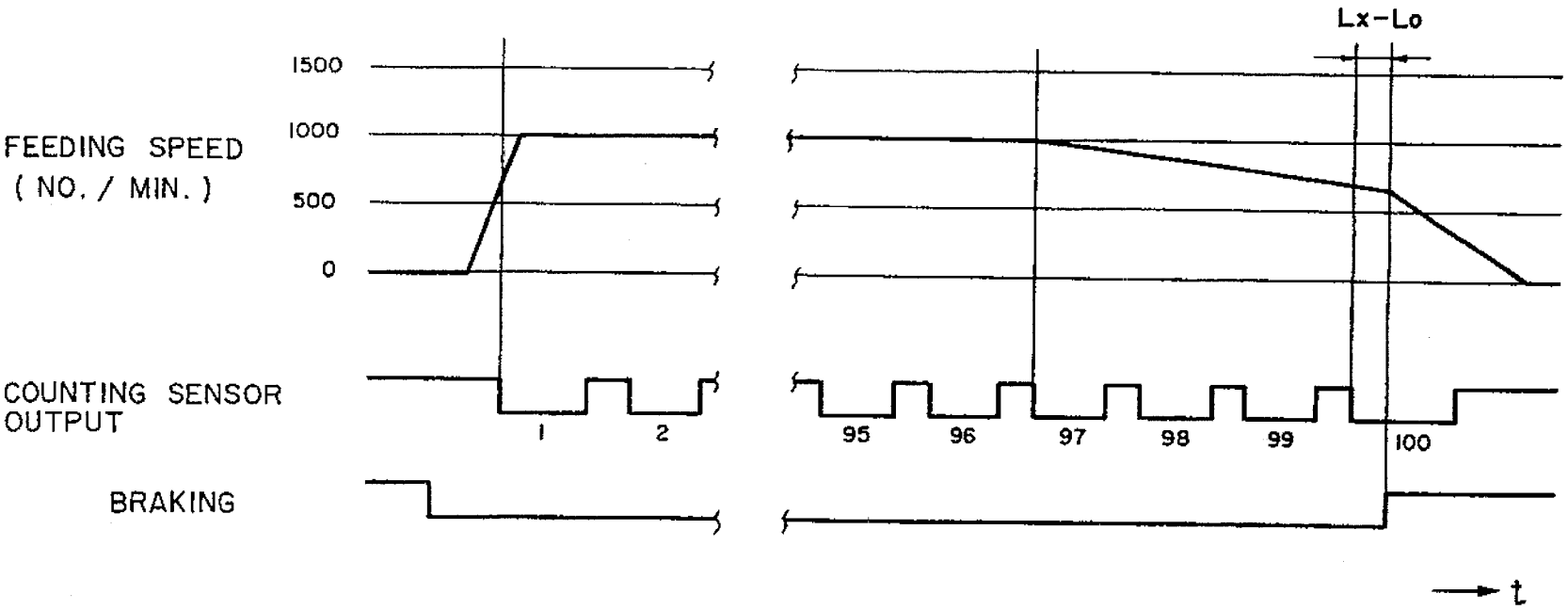
FIG. 10 is a timing chart showing the operation of the sheet counter system shown in FIG. 1.
Figure 11:
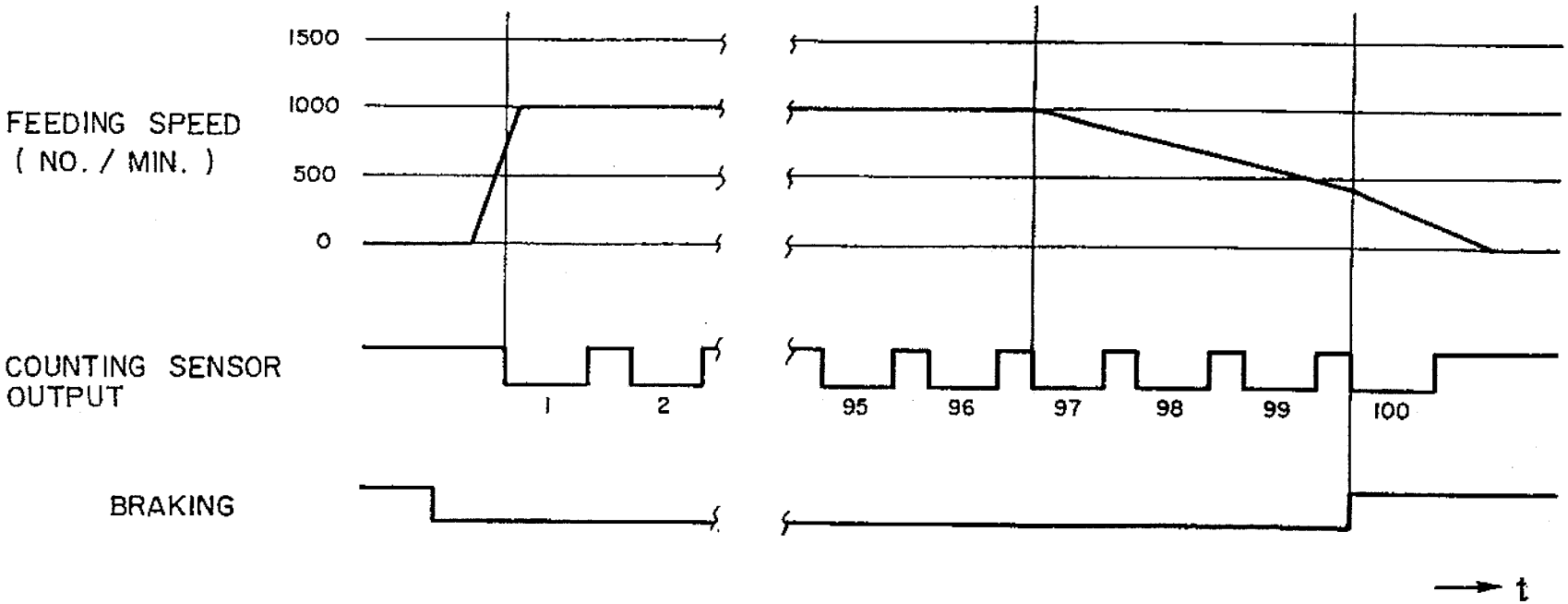
FIG. 11 is a timing chart showing the operation of the sheet counter system shown in FIG. 1.
Figure 12:
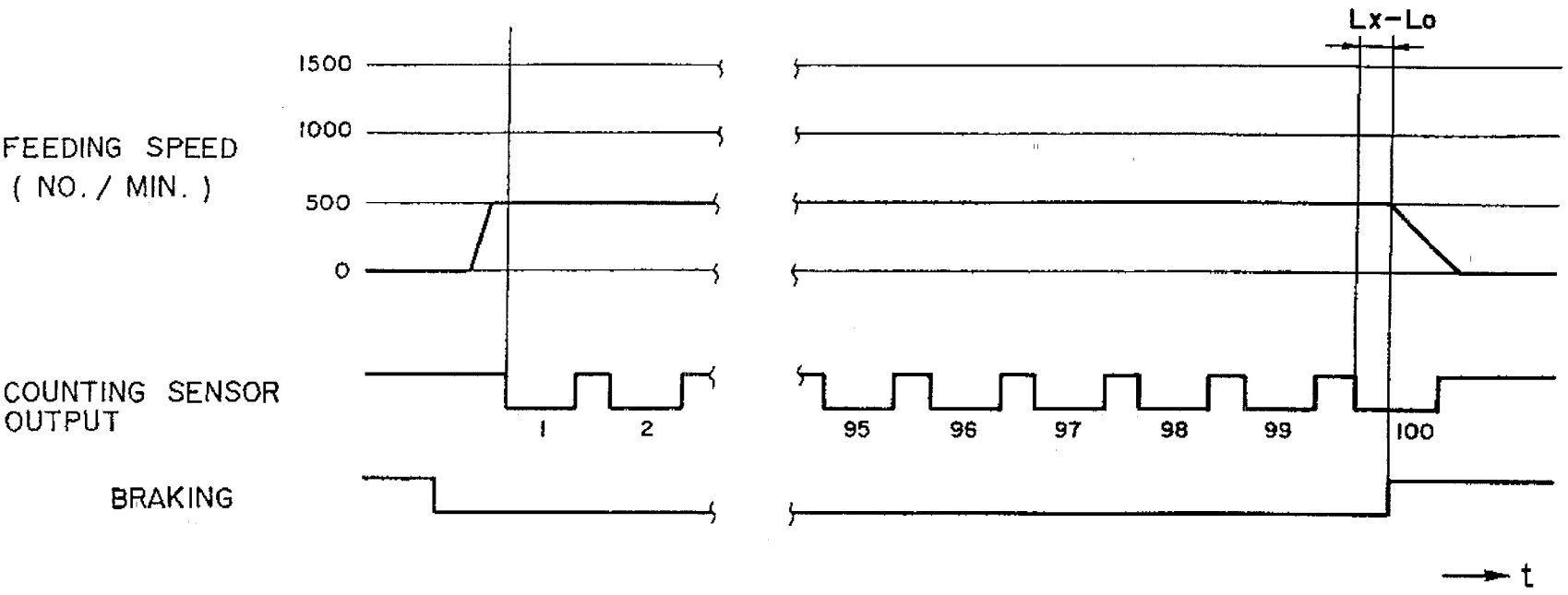
FIG. 12 is a timing chart showing the operation of the sheet counter system shown in FIG. 1.

In the case where the speed mode setting is 1000/minute, when the front end of the ninety seventh bill 10 reaches the position on the counting sensor $S_2$, the DC motor $M_1$ is decelerated or braked so that the speed of 500/minute is provided (ST 403, see FIGS. 10 and 11).

Judgment as to whether or not the count value of the counting sensor $S_2$ reaches 100 (batch number) is repeated (ST 404). As a result, when it is judged that the front end of the hundredth bill 10 reaches the position on the counting sensor $S_2$, if the bill length $L_x$ is greater than the length reference value $L_0$ (60 mm) and the speed of the DC motor $M_1$ (measured value by the encoder $S_4$) is smaller than the speed reference value (which is assumed to be "1000/minute" in this case), the control unit 21 carries the bill 10 by a predetermined distance ($L_x$-$L_0$) thereafter to sequentially carry out braking of respective DC motors $M_1$, $M_2$ (ST 405–ST409), thus to stop these motors (see FIG. 10). It is to be noted that since deceleration or braking is carried out from the speed of 1000/minute, the speed is necessarily smaller than the speed reference value (1000/minute). In the case where $L_x$ is greater than $L_0$, such an operation is necessarily carried out.

On the other hand, when the bill length $L_x$ is less than the length reference value, i.e., 60 mm (ST 405 and 406), the control unit 21 immediately carries out braking of the DC motor $M_1$ at the time point when the front end of the hundredth bill reaches the counting sensor $S_2$ (ST 408) to stop the DC motor $M_1$ (see FIG. 11). In accordance with the same procedure as in the above-described case, braking of the DC motor $M_2$ is carried out (ST 409).

Figure 5:
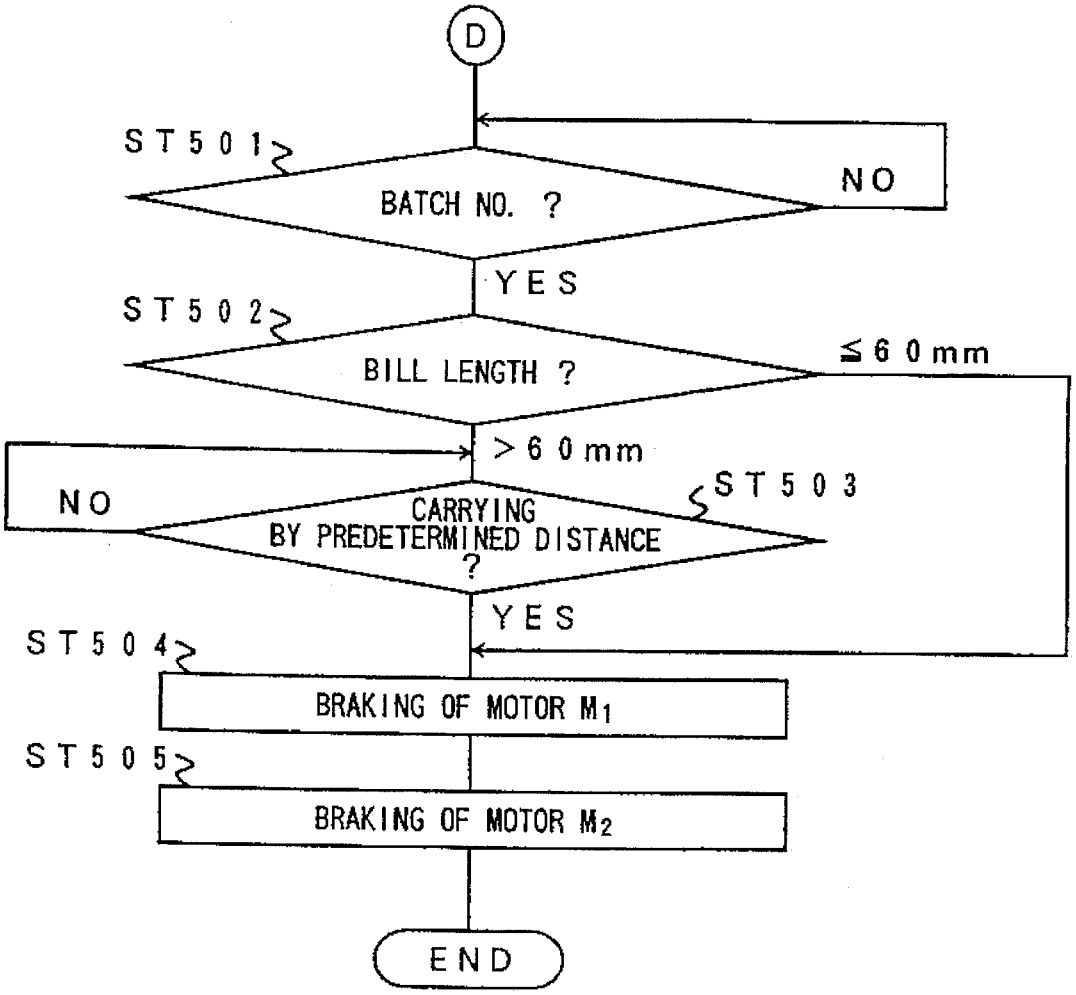
FIG. 5 is a flowchart showing the operations of the sheet counter system shown in FIG. 1.

Furthermore, when the speed mode setting is 500/minute, judgment as to whether or not the count value of the counting sensor $S_2$ reaches 100 (batch number) is repeated (FIG. 5; ST 501). When the front end of the hundredth bill 10 reaches the position on the counting sensor $S_2$, if the bill length $L_x$ is greater than the length reference value $L_0$ (60 mm), the control unit 21 carries this bill 10 by a predetermined distance ($L_x$-$L_0$) thereafter to carry out braking of the DC motors $M_1$, $M_2$ (ST502–ST505) in accordance with the same procedure as in the steps ST 408, ST 409 to stop these motors (see FIG. 12). Thus, the DC motors $M_1$, $M_2$ are prevented from being stopped before the final bill 10 is taken into the stacker fan 18.

Figure 13:
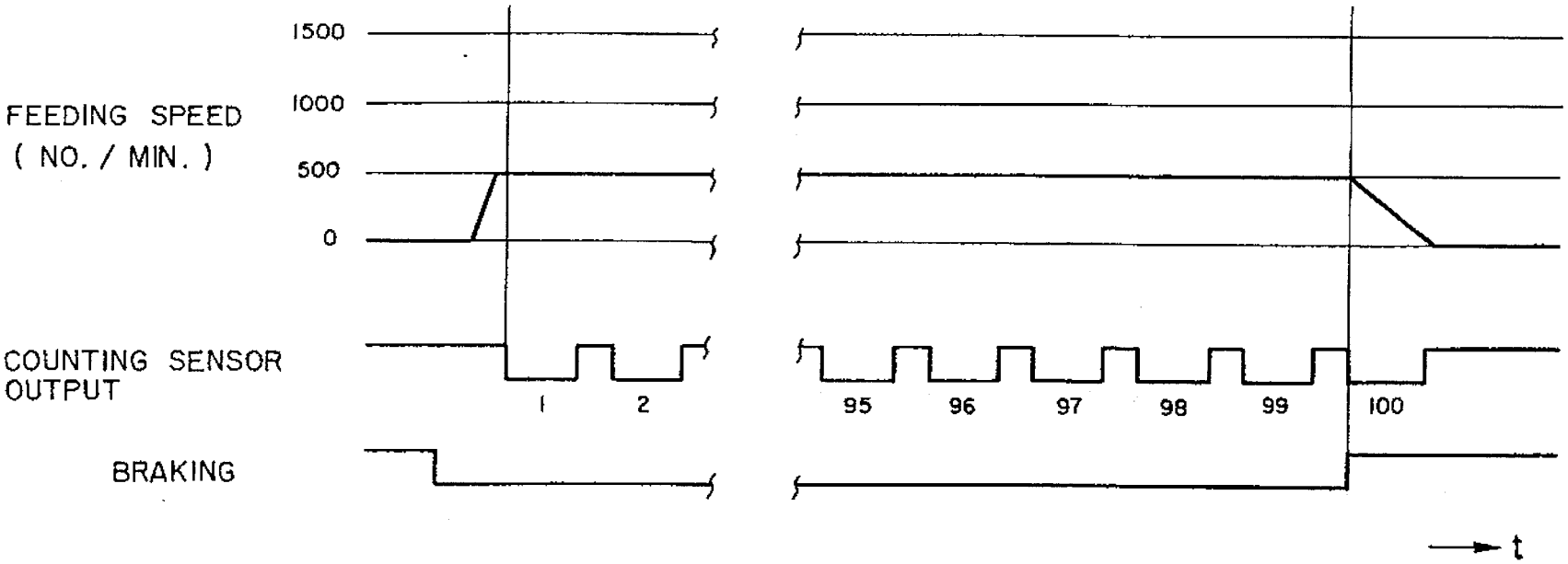
FIG. 13 is a timing chart showing the operation of the sheet counter system shown in FIG. 1.

On the other hand, when the bill length $L_x$ is less than 60 mm, the control unit 21 immediately carries out braking of the DC motors $M_1$, $M_2$ (ST502–ST505) to stop these motors (see FIG. 13). Thus, the next (one hundred first) sheet or the like can be prevented from being fed out from the rollers 13, 14.

Explanation will now be given in connection with the case where an ordinary counting processing mode is designated as the result of judgment at ST 302 (see FIG. 3).

Figure 6:
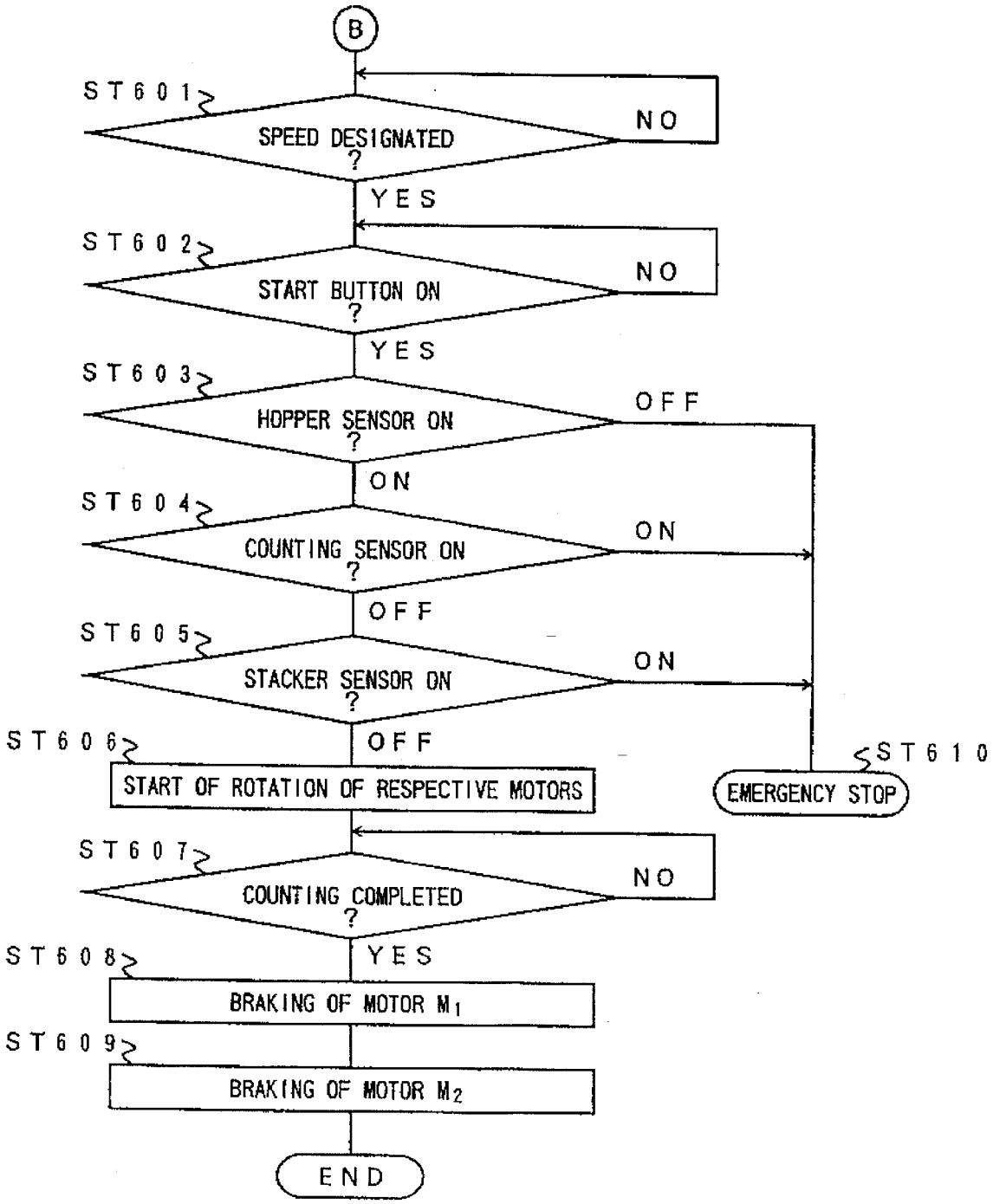
FIG. 6 is a flowchart showing the operations of the sheet counter system shown in FIG. 1.

In this case, the control unit 21 first repeats checking as to whether or not designation of speed by the operation panel 22 is carried out (FIG. 6; ST 601). As a result, when that speed is designated, checking as to whether or not the start button is turned ON is then repeated (ST 602).

When the start button is turned ON, the control unit 21 checks the hopper sensor $S_1$ (ST 603). As a result, when the hopper sensor $S_1$ is in an OFF state, the control unit 21 judges that there is no bill 10 within the hopper section 11 to stop the counter system, thus informing an operator by an alarm, etc. (ST 610).

On the other hand, in the case where the hopper sensor $S_1$ is turned ON, the control unit 21 then checks the counting sensor $S_2$ (ST 604). As a result, when the counting sensor $S_2$ is in an ON state, the control unit 21 judges that a bill 10 exists to stop the counter system (ST 610). In contrast, when the counting sensor $S_2$ is in an OFF state, the control unit 21 then checks the stacker sensor $S_3$ (ST 605). As a result, when the stacker sensor $S_3$ is in an ON state, the control unit 21 judges that a bill 10 exists to stop the counter system (ST 610). In contrast, if the stacker sensor $S_3$ is in an OFF state, the control unit 21 judges that there is no extraordinary state, thus to start rotation of the DC motors $M_1$, $M_2$ (ST 606).

Then, the control unit 21 repeats, by using the hopper sensor $S_1$ and the counting sensor $S_2$, checking as to whether all bills 10 are carried or transferred from the hopper section 11 to the stacker 20 (i.e., whether or not the counting processing is completed) (ST 607). As a result, when the count processing is completed, the control unit 21 carries out braking of the DC motors $M_1$, $M_2$ in accordance with the same procedure as those of steps ST 408, ST 409 (ST 608, 609) to stop these motors.

Explanation will now be given in connection with the case where a designated batch number is 1 (one) as the result of judgment at ST 309 (see FIG. 3).

Figure 7:
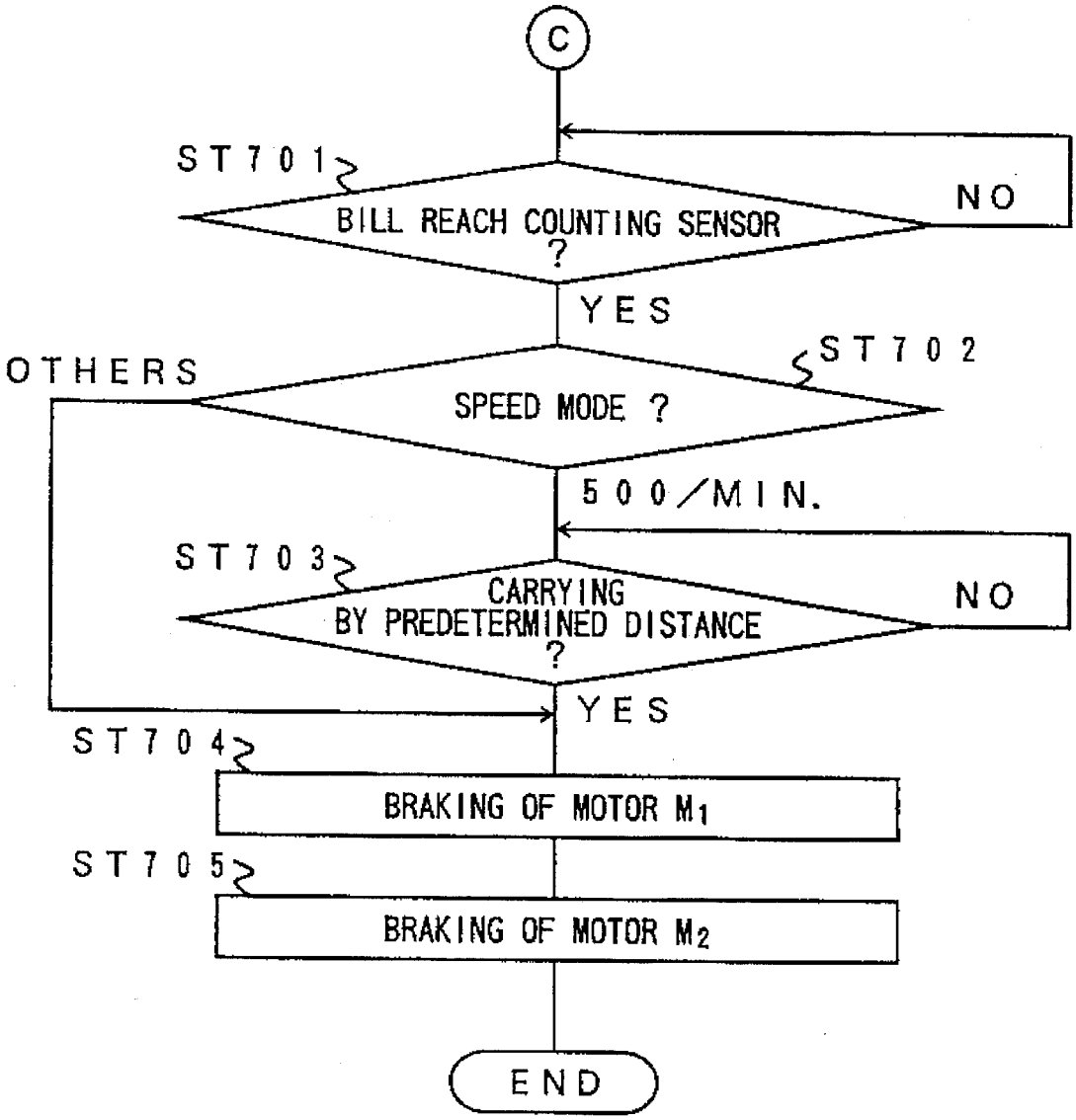
FIG. 7 is a flowchart showing the operations of the sheet counter system shown in FIG. 1.

In this case, in the beginning, the control unit 21 repeats checking as to whether or not the front or leading end of the bill 10 reaches the counting sensor $S_2$ (FIG. 7; ST 701).

Figure 14A:
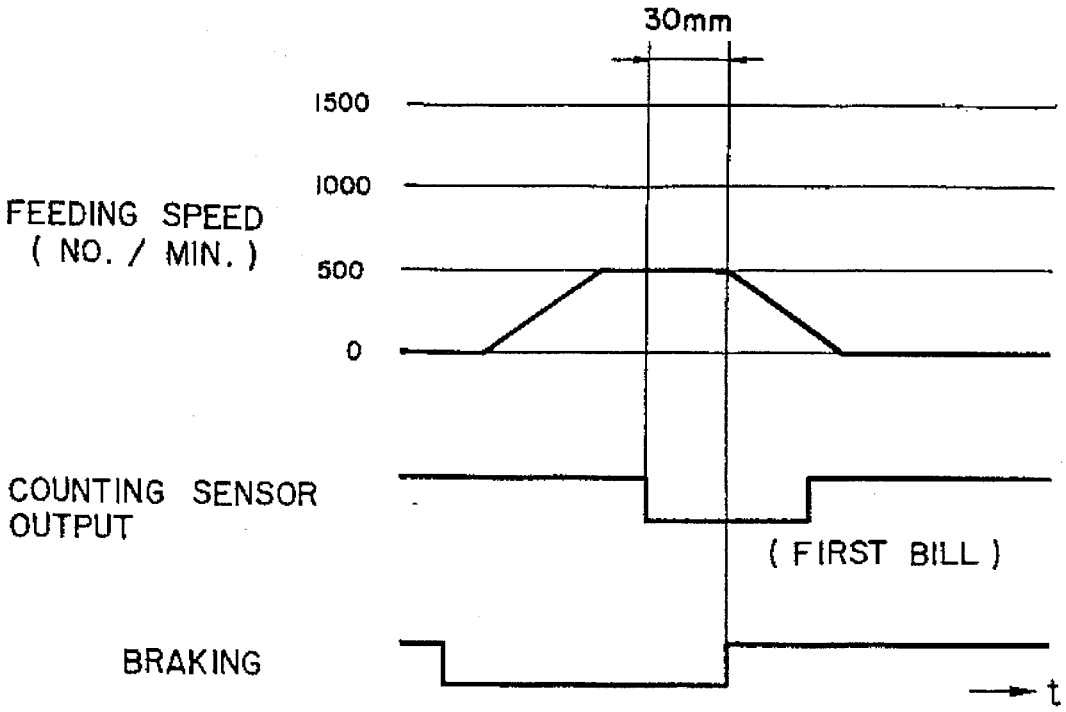
FIG. 14A is a timing chart showing the operation of the sheet counter system shown in FIG. 1.

When the front end of the bill 10 reaches the counting sensor $S_2$, the control unit 21 carries the bill 10 by a predetermined distance in the case where the speed mode is 500/minute, thereafter to carry out braking of the DC motors $M_1$, $M_2$ (ST702–ST705) in accordance with the same procedure as those of ST 408, ST 409 to stop these motors (see FIG. 14A).

When the batch number is 1, it is not possible to measure the length of the bill. Therefore, in this case, it is impossible to set "a predetermined distance", i.e., a carrying quantity of the bill 10 to $L_x$-$L_0$. Accordingly, the bill length is considered to be 90 mm to calculate $L_x$-$L_0$ ("the predetermined distance" is thus equal to 30 mm in the case of this embodiment). When the bath number is 1, braking is to be ordinarily carried out immediately after or before the carrying speed reaches a designated value (value of the speed mode). Accordingly, in order to prevent the DC motor $M_1$ from being stopped before the first bill 10 is taken into the stacker fan 18, it is desirable to set the estimated value of the bill length to a longer value.

Figure 14B:
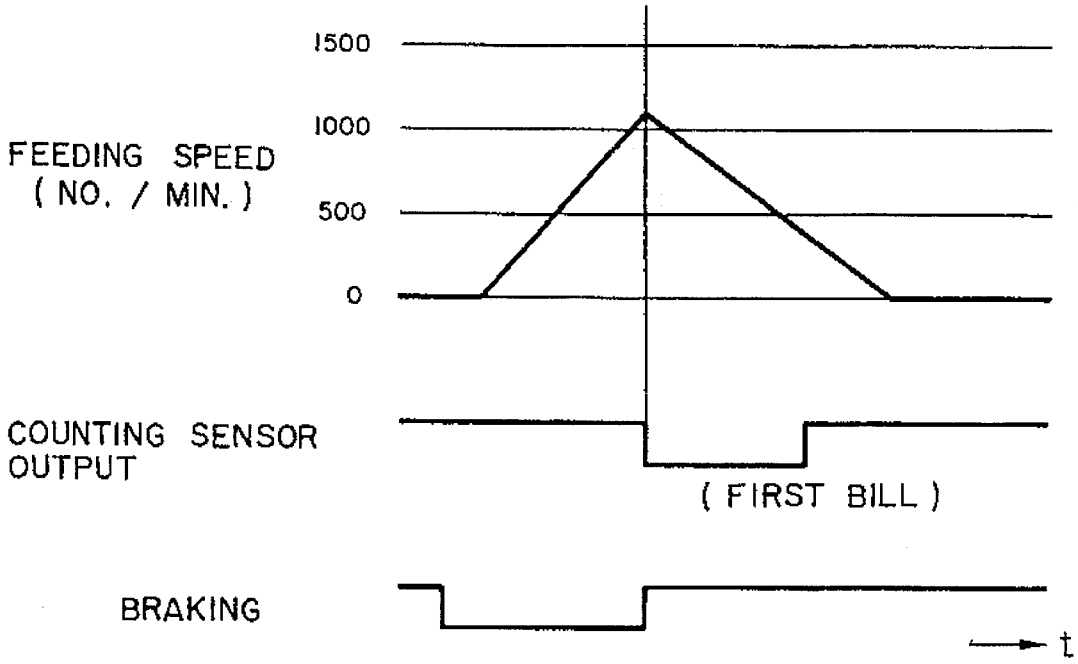
FIG. 14B is a timing chart showing the operation of the sheet counter system shown in FIG. 1.

On the other hand, in the case where the speed mode is 1000/minute or 1500/minute, the control unit 21 immediately carries out braking of the DC motor $M_1$ (ST 702, ST 704) to stop this motor (see FIG. 14B. This figure shows the example of 1500/minute). The control unit 21 stops the DC motor $M_2$ in accordance with the same procedure of that at ST 409 (ST 705).

As explained above, in the bill counter system according to this embodiment, in the case where the bill length is long and a feeding speed when the front end of a bill of the batch number is detected by the counting means is low, this bill 10 is caused to be carried or transferred by a predetermined distance and braking is then carried out. Accordingly, it hardly occurs that the DC motor $M_1$ is stopped with the back or trailing end of the bill 10 being between roller pair 13, 14, or remaining within the hopper section 11, so the bill 10 fails to be stacked within the stacker 20.

In addition, in the case where the bill length is long and a feeding speed at the point in time when the front end of a bill of the batch number is detected by the counting means is high, or in the case where the bill length is short, braking of the DC motor $M_1$ is carried out immediately when the bill of the batch number is detected by the counting means. Accordingly, there is no possibility that the next (one hundred first) bill will be fed out from the rollers 13, 14.

In this embodiment, measurement of the feeding speed is carried out by the encoder $S_4$. The fly-wheel 16*a* doubling as a slit circular plate measured by the encoder $S_4$ can rotate by inertia through the one-way clutch. Namely, since when the DC motor $M_1$ rotates while accelerating (at the time of starting) or rotates at a constant speed, rotation of the DC motor $M_1$ is transmitted to the fly-wheel 16*a*. Accordingly, a measured value of the encoder $S_4$ for measuring rotation of the fly-wheel 16*a* is considered to be based on a value obtained by carrying out measurement of rotation of the DC motor $M_1$. In this embodiment, the following measure is taken with a view to reducing the cost of the system. Namely, measurement of the carrying speed of the bill and measurement of the feeding speed of the bill are carried out commonly by using the encoder $S_4$. Since the bill feeding speed and the rotational speed of the DC motor $M_1$ are in proportion to each other, measurement of the bill feeding speed is also measurement of the rotational speed of the DC motor $M_1$.

However, this invention is not limited to the above-described embodiment. In the case where measurement of an accurate feeding speed is desired, there may be employed a configuration such that a slit circular plate is fixed on the feed roller shaft where feed rollers 13, 13, 13' are fixed to measure its rotation by using the encoder $S_4$.

When the speed mode is 1500/minute, deceleration or braking is started from the ninety sixth sheet (bill) or the like. Further, when the speed mode is 1000/minute, deceleration or braking is started from the ninety seventh sheet (bill) or the like. In other words, deceleration or braking is applied at the count time point when the minimum sheets in which deceleration and braking can be carried out in dependency upon processing, speed are left(the ninety sixth or the ninety seventh sheet (bill) in the above-described embodiment. This is done in order to allow the counter system to carry out constant speed processing of as many sheets as possible to improve processing efficiency. It is a matter of course that the number of sheets may fixed irrespective of speed.

It is therefore a matter of course that a fixed number of sheets of the expression of "sheet or the like preceding by a fixed number of sheets" in the invention may be different sets of fixed numbers of sheets in dependency upon alternation of the carrying speed mode, or may be fixed irrespective of alteration of the carrying speed mode.

It is to be noted that the stacking means according to the present invention is not limited to the embodiment which uses the stacker fan as described above. For example, a stacker having toothed rollers at an entrance thereof as shown in U.S. Pat. No. 3,909,982, the toothed rollers being disposed between the trailing ends of the stacked sheets and the front or leading ends of the sheets to be fed to locate the front end of the sheets to the upper part of the stacked sheets, or a stacker using endless belts instead of the above-mentioned toothed rollers for performing the same function as above, which is shown in the U.S. Pat. No. 4,285,511, can be employed.

What is claimed is:

1. A sheet counter system comprising:

feeding means for feeding out, one by one, sheets stacked within a hopper section, each said sheet having a sheet length;

carrying means for carrying the sheets fed out by said feeding means;

counting means for counting the sheets carried by said carrying means;

stacking means for stacking the sheets counted by said counting means; and control means operable such that, when the sheet length is less than a length reference value, said control means starts braking of said feeding means when a leading end of an n-th sheet, wherein n is a predetermined integer greater than 1, of the sheets which have been fed by said feeding means is detected by said counting means, and when the sheet length is greater than said length reference value, said control means starts braking of said feeding means when a carrying distance after the leading end of the n-th sheet of the sheets which have been fed out by said feeding means is detected by said counting means reaches a predetermined distance, to thereby stop feeding by said feeding means when a counted result of said counting means reaches a predetermined number of sheets.

2. A sheet counter system as claimed in claim 1, wherein said predetermined distance comprises a difference between the sheet length and said length reference value.

3. A sheet counter as claimed in claim 1, further comprising means, operably coupled to said control means, to determine the sheet length.

4. A sheet counter as claimed in claim 1, further comprising means, operably coupled to said control means, to determine said carrying distance.

5. A sheet counter system comprising:

feeding means for feeding out at a feeding speed, one by one, sheets stacked within a hopper section, each such sheet having a sheet length;

carrying means for carrying the sheets fed out by said feeding means;

counting means for counting the sheets carried by said carrying means;

stacking means for stacking the sheets counted by said counting means; and control means operable such that, when a sheet preceding by a fixed number m, wherein m is a predetermined integer, of sheets relative to an n-th sheet, wherein n is a predetermined integer greater than 1, of sheets which have been fed by said feeding means, is detected by said counting means, said control means starts braking of said feeding means, when the sheet length is less than a length reference value and when the sheet length is greater than said length reference value and said feeding speed when a leading end of the n-th sheet is detected by said counting means is above a speed reference value, said control means starts braking of said feeding means when the leading end of the n-th sheet is detected, and when the sheet length of the sheet is greater than said length reference value and said feeding speed when the leading end of the n-th sheet is detected by said counting means is smaller than said speed reference value, said control means starts braking of said feeding means when a carrying distance from a time of detection of the leading end of the n-th sheet reaches a predetermined distance, to thereby stop feeding by said feeding means when a counted result of said counting means reaches a predetermined number of sheets.

6. A sheet counter system as claimed in claim 5, wherein said predetermined distance comprises a difference between the sheet length and said length reference value.

7. A sheet counter as claimed in claim 5, further comprising means, operably coupled to said control means, to determine the sheet length.

8. A sheet counter as claimed in claim 5, further comprising means for selecting said feeding speed.

9. A sheet counter as claimed in claim 5, further comprising means, operably coupled to said control means, to determine said feeding speed.

10. A sheet counter as claimed in claim 5, further comprising means, operably coupled to said control means, to determine said carrying distance.

* * * * *